US006939417B2

(12) United States Patent
Marois et al.

(10) Patent No.: US 6,939,417 B2
(45) Date of Patent: Sep. 6, 2005

(54) ALUMINUM ALLOYS HAVING HIGH CORROSION RESISTANCE AFTER BRAZING

(75) Inventors: Pierre Henri Marois, Kingston (CA); Nicholas Parson, Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 10/204,428

(22) PCT Filed: Mar. 6, 2001

(86) PCT No.: PCT/CA01/00276

§ 371 (c)(1),
(2), (4) Date: Dec. 5, 2002

(87) PCT Pub. No.: WO01/66812

PCT Pub. Date: Sep. 13, 2001

(65) Prior Publication Data

US 2003/0150532 A1 Aug. 14, 2003

Related U.S. Application Data

(60) Provisional application No. 60/187,835, filed on Mar. 8, 2000.

(51) Int. Cl.[7] ..... C22C 21/00

(52) U.S. Cl. ..... 148/437; 420/548; 420/553

(58) Field of Search ..... 148/437; 420/548, 420/553

(56) References Cited

U.S. PATENT DOCUMENTS 5,286,316 A * 2/1994 Wade ..... 148/550

FOREIGN PATENT DOCUMENTS

| | | | |
|---|---|---|---|
| CA | 2247037 | 9/1998 | ..... 22/21 |
| EP | 0 899 350 | 3/1999 | ..... 22/21 |
| WO | WO 97/46726 | 12/1997 | ..... 22/21 |
| WO | WO 99/04051 | 1/1999 | ..... 22/21 |

* cited by examiner

*Primary Examiner*—George Wyszomierski
*Assistant Examiner*—Janelle Morillo
(74) *Attorney, Agent, or Firm*—Cooper Dunham LLP

(57) ABSTRACT

When using AA3000 series and AA1000 series aluminum alloys to produce extruded products for heat exchanger applications, by controlling the level of copper and nickel in the alloy to very low levels it is possible to produce excellent corrosion resistance both before and after a brazing cycle. To achieve these results, the copper content should be no more than 0.006% by weight and the nickel no more than 0.005% by weight. A typical alloy of the invention contains about 0.001–0.5% by weight manganese, 0.001–0.7% by weight iron, 0.001–0.02% by weight titanium, 0.001–0.3% by weight silicon, less than 0.006% by weight copper, less than 0.005% by weight nickel and 0.001–0.02% by weight zinc, with the balance consisting of aluminum and incidental impurities. No zinc addition to the alloy is required either by zinc spraying or by alloy addition.

5 Claims, No Drawings

ALUMINUM ALLOYS HAVING HIGH CORROSION RESISTANCE AFTER BRAZING

CROSS-REFERENCE TO RELATED APPLICATION

This application claims the priority right of provisional application Ser. No. 60/187,835 filed Mar. 8, 2000 by applicants herein.

TECHNICAL FIELD

This invention relates to corrosion resistant aluminum alloys and, more particularly, to an AA3000 series type aluminum alloy having low levels of copper and nickel and showing excellent corrosion resistance after brazing.

BACKGROUND ART

Aluminum alloys are well recognized for their corrosion resistance. In the automotive industry, aluminum alloys are used extensively for tubing because of their extrudability as well as the combination of light weight and high strength. They are used particularly for heat exchanger or air conditioning condenser applications, where excellent strength, corrosion resistance and extrudability are necessary.

The AA1000 series aluminum alloys are often selected where corrosion resistance is needed. Where higher strengths are required, the AA3000 series aluminum alloys are often used.

A difficulty with use of aluminum alloys in corrosive environments, such as heat exchanger tubing, is pitting corrosion. There are various methods currently in use for protecting tubing manufactured from clad sheet stock from corrosion. One of these consists of using a core alloy e.g. X800 or X900, which protects from corrosion through the formation of a dense precipitate band within the core adjacent to the cladding. This band corrodes preferentially to the rest of the core thereby increasing the life of the tube. This method is only applicable to sheet products due to the need for a clad layer of Al—Si alloy on the tube surface.

Alloys currently in use for brazed extruded tubing do not give good corrosion resistance unless the tubing is sprayed with zinc prior to brazing. This is typically carried out in-line at the extrusion press and is costly and undesirable from an environmental viewpoint.

Sircar, WO 97/46726, published Dec. 11, 1997 describes a corrosion resistant AA3000 series aluminum alloy containing low copper, but high zinc and titanium. While this alloy provides reduced corrosion, its titanium content of 0.03 to 0.30% by weight raises the pressures required for extrusion, thereby lowering productivity.

U.S. Pat. No. 5,286,316 (Wade) describes an alloy consisting essentially of 0.1–0.29% by weight manganese, 0.05–0.12% by weight silicon, 0.10–0.20% by weight titanium, 0.15–0.25% by weight iron with the balance aluminum. This alloy contained very low levels of copper not exceeding 0.03% by weight, but again a quite high titanium content.

In Auran et al, EP 0899350, published Mar. 3, 1999, a corrosion resistant alloy is described containing 0.10–0.40% by weight iron, 0.05–0.25% by weight silicon, 0.12–0.22% by weight titanium, less than 0.10% by weight manganese, less than 0.35% by weight copper and the balance aluminum.

In Auran et all WO 99/04051, published Jan. 28, 1999, another corrosion resistant alloy is described preferably consisting of 0.06–0.15% by weight iron, 0.05–0.15% by weight silicon, 0.03–0.08% by weight manganese, 0.10–0.18% by weight titanium, 0.10–0.18% by weight chromium, less than 0.01% by weight copper, 0.10–0.18% by weight zinc and the balance aluminum.

Jeffrey et al., CA 2,247,037 teaches extruding aluminum alloys having generally high zinc and low titanium into heat exchanges tubing. Corrosion testing was conducted on tubing which had not been exposed to furnace brazing conditions. An alloy with a low zinc content (0.0022%) failed the corrosion test.

Other references include Hufnagel W., "Key to Aluminum Alloys, 4th Edition" 1992 showing typical compositions for 1000 and 3000 series aluminum alloys.

U.S. Pat. No. 5,976,278 describes an aluminum alloy containing up to 0.03% copper, 0.1–1.5% manganese, 0.03–0.35% titanium, up to 1.0% magnesium, up to 0.01% nickel, 0.06–1.0% zinc, up to 0.3% zirconium, up to 0.50% iron and silicon and up to 0.20% chromium.

An aluminum alloy is described in U.S. Pat. No. 5,906,689 containing up to 0.03% copper, 0.1–0.5% manganese, 0.03–0.30% titanium, 0.06–1.0% zinc, up to 0.50% iron, 0.05–0.12% silicon, up to 0.01% manganese, up to 0.01% nickel and up to 0.5% chromium.

In U.S. Pat. No. 5,286,316, an aluminum alloy is described containing 0.1–0.5% manganese, 0.05–0.12% silicon, 0.10–0.20% titanium and 0.15–0.25% iron.

JP-A-2000–119784 describes a further aluminum alloy containing manganese along with magnesium, copper, silicon, zinc, nickel and iron.

It is an object of this invention to produce an aluminum alloy of the AA3000 type having excellent corrosion resistance when extruded into tubing and brazed without the need to add zinc by either zinc spraying or by alloy addition.

DISCLOSURE OF THE INVENTION

It has been found according to the present invention that when using AA3000 series aluminum alloys to produce extruded products for heat exchanger applications, by controlling the level of copper and nickel in the alloy to very low levels it is possible to produce excellent corrosion resistance both before and after a brazing cycle. To achieve these results, the copper content of the alloy is no greater than 0.006% by weight and the nickel content is no greater than 0.005% by weight. These alloys typically contain up to about 1.5% by weight manganese, up to about 0.70% by weight iron, up to about 0.02% by weight titanium, up to about 0.30% by weight silicon, less than about 0.03% by weight zinc and the minimum copper and nickel contents as stated above. The balance consists of aluminum and incidental impurities.

According to a preferred embodiment, the alloy of the extruded product of the invention is an aluminum alloy containing about 0.001–0.5% by weight manganese, 0.001–0.7% by weight iron, 0.001–0.02% by weight titanium, 0.001–0.3% by weight silicon, less than 0.006% by weight copper, less than 0.005% by weight nickel and 0.001–0.02% by weight zinc, with the balance consisting of aluminum and incidental impurities.

According to another preferred embodiment, the alloy of the extruded product of the invention contains less than 0.03% by weight zinc and has a corrosion resistance sufficient to pass a 20 day SWAAT corrosion test.

Although individual aluminum smelters may already exist that produce aluminum containing the above low levels of copper and nickel, the value of having a product with such low levels was not previously recognized. Accordingly, no effort has been made to isolate ingots during aluminum production such that a population of commercial aluminum ingots when re-heated for extruding into tubing will provide a melt containing less than 0.006% copper and less than 0.005% nickel. It is a feature of this invention that a population of aluminum alloy ingots used for extrusion into tubing will on average contain less than 0.006% copper and less than 0.005% nickel. Thus, a population of ingots is selected whereby the aggregate population has the above composition.

A typical alloy used in the present invention not only has very low levels of copper and nickel but may also be used without any deliberate additions of titanium or zinc. Thus, the extruded product may be devoid of any surface coating of zinc. The low level of titanium present is typically that remaining from grain refiner addition.

When these alloys are extruded into heat exchanger tubing, and especially micro-port tubing, they produce sufficient corrosion resistance on their own, thereby eliminating any need for the traditional zinc thermo-spraying step. However, when these alloys are combined with a zinc spraying step the corrosion performance will be further improved. It is a particularly significant feature of these alloys containing very low levels of copper and nickel that they can be extruded into tubing and processed through a vacuum or inert atmosphere brazing cycle, while still exhibiting excellent corrosion resistance. These alloys also give excellent corrosion resistance for tubing used in mechanically assembled heat exchangers where no brazing cycle is used.

The extruded products of these inventions having high corrosion resistance are typically produced by the following steps:

a) casting an ingot of an aluminum alloy as described above;
b) homogenizing the ingot at a temperature between about 400° C. and about 650° C.;
c) cooling the ingot to ambient temperature;
d) re-heating the ingot and extruding into tubing.

When the tubing is subjected to a brazing cycle, this is done either in a vacuum or an inert atmosphere. For the brazing, the tubing is typically heated at a rate of about 5 to 30° C./min up to a temperature of about 585 to 615° C. followed by rapid cooling.

BEST MODE FOR CARYING OUT THE INVENTION

EXAMPLE 1

A series of alloy compositions based on AA3102 aluminum alloy were D.C. cast as 4" diameter ingots. These had fixed iron, silicon and manganese contents but contained incremental additions of copper and nickel. The titanium was present only from grain refiner addition and was not a deliberate alloy addition. There was no deliberate addition of zinc and a background level of 0.005/0.006 wt % was present in the aluminum used to make up the melt. Also included was a commercially produced AA3102 alloy. The latter was cast as a 6" diameter ingot.

These alloy compositions are shown in Table 1 below:

TABLE 1

| Cast | H309 | H310 | H311 | J370 | J371 | 1372 | Commercial 3102 |
|---|---|---|---|---|---|---|---|
| Si | 0.08 | 0.08 | 0.08 | 0.08 | 0.08 | 0.08 | 0.08 |
| Fe | 0.44 | 0.45 | 0.44 | 0.44 | 0.44 | 0.45 | 0.44 |
| Cu | 0.001 | <0.001 | 0.001 | 0.006 | 0.013 | 0.022 | <0.02 |
| Mn | 0.23 | 0.23 | 0.23 | 0.23 | 0.23 | 0.23 | 0.24 |
| Zn | 0.005 | 0.005 | 0.005 | 0.006 | 0.006 | 0.006 | <0.02 |
| Ni | 0.001 | 0.002 | 0.0052 | 0.0009 | 0.001 | 0.001 | <0.01 |
| Ti | 0.008 | 0.01 | 0.007 | 0.008 | 0.007 | 0.007 | |
| Brazed Performance | 0/5 | 0/5 | 2/5 | 4/5 | 5/5 | 5/5 | 5/5 |
| As Extruded Performance | 0/5 | 0/5 | 0/5 | 0/5 | 5/5 | 5/5 | 5/5 |

The ingots were homogenized for 4 hrs. at 620° C. and cooled at 150° C./hr to room temperature. The metal was extruded into a 0.25 inch diameter round tube having a wall thickness of 0.016 inch using normal extrusion conditions and the product was air cooled to room temperature. The tubing was cut into 8 inch lengths. Five lengths of each alloy were given an inert atmosphere brazing cycle consisting of 20° C./min up to 625° C. followed by fast cooling to room temperature, and five were kept in the as-extruded condition. The tubes were then exposed to a corrosive environment in a SWAAT cabinet according to ASTM spec #G85—Annex A3. After twenty days exposure the tubes were removed and checked for perforation using compressed air at a pressure of 80 psi. The table above lists the number out of five that perforated for the brazed and non brazed conditions. In the non brazed condition no tubes failed providing the copper content was 0.006 wt % or less. After a brazing cycle no tubes failed providing the copper content was less than 0.006 wt % and nickel was less than 0.005 wt %. This shows that a long post brazed life can be achieved in a regular AA3102 Al—Mn type alloy extrusion if copper and nickel impurity levels are maintained below critical values (0.006 and 0.005 wt % respectively).

EXAMPLE 2

A further series of four AA3102 type Al—Mn alloy compositions were D.C. cast as 6" diameter billets. The aluminum used to make up the melts was selected to have a copper content of 0.0012–0.0015 wt %. The nickel content was 0.0015 to 0.0019 wt %. The base level of zinc in the aluminum was 0.0021–0.0025 wt %. The four casts were alloyed so as to produce the following variants:

Low iron low zinc
Low iron high zinc
High iron low zinc
High iron high zinc

The compositions are shown in Table 2 below:

TABLE 2

| Cast | Si | Fe | Cu | Mn | Zn | Ni | Ti |
|---|---|---|---|---|---|---|---|
| MNL | 0.072 | 0.077 | 0.0012 | 0.21 | 0.0021 | 0.0015 | 0.0048 |
| MNM | 0.07 | 0.076 | 0.0012 | 0.23 | 0.0225 | 0.0015 | 0.0048 |
| MNO | 0.061 | 0.44 | 0.0015 | 0.23 | 0.0025 | 0.0018 | 0.0044 |
| MNP | 0.064 | 0.45 | 0.0015 | 0.23 | 0.0213 | 0.0019 | 0.0045 |

Silicon levels were maintained at ~0.07 wt % and Mn was maintained at ~0.23 wt % for all the casts. The titanium content was due to the addition of Ti/B grain refiner used to control the cast grain size and was not a deliberate alloy addition. The billets were homogenized using the same procedure as in Example 1 and were extruded into a 0.25 inch×0.016 inch round tube. The tubing was cut into 8 inch lengths and given a simulated vacuum brazing cycle. The cycle consisted of a 25° C./min heat up to 500° C. followed by 15° C./min to 600° C. then 5° C./min to 615° C. The samples actually received about 2 min soak between 600° C. and 607° C. then were cooled in the furnace until 500° C. (about 5 minutes) before being removed from furnace. A vacuum at about $5\times10^{-5}$ Torr was used at brazing temperature.

The samples were then corrosion tested using SWAAT test as described in Example 1 and samples were taken out after 20 (2 tubes each), 25 (2 tubes each), 30 (2 tubes each) and 40 days (6 tubes each). The tubes were tested for perforation using compressed air at 80 psi. Table 3 below summarized the results:

TABLE 3

| Cast | 20 days | 25 days | 30 days | 40 days |
|---|---|---|---|---|
| MNL | OK | OK | OK | 5 out of 6 OK |
| MNM | OK | OK | 1 out of 2 OK | 4 out of 6 perf. |
| MNO | OK | OK | OK | 5 out of 6 OK |
| MNP | OK | OK | 1 out of 2 OK | All perf. |

All of the tubes passed a 20-day SWAAT test, which was the criterion in Example 1, and also passed 25 days exposure. This supports the conclusion of Example 1 that an alloy with Ni less than 0.005 and Cu less than 0.006 wt % can pass a 20 day SWAAT post brazed. After thirty days exposure, failures were observed in the alloys containing the higher level of zinc. After 40 days exposure some perforations were encountered for all the alloys but the performance of the compositions with the higher zinc level was noticeably inferior. At the lower zinc level there was no measurable effect associated with changing the iron level from 0.07 to 0.44 and both alloys performed in an equivalent manner. This shows that maintaining low copper (<0.006 wt %) and nickel (<0.005 wt %) gives 25 days SWAAT life post brazed for iron levels of 0.07 to 0.44 wt % and zinc levels of 0.002 to 0.025 wt %. Superior performance can be achieved (up to 30 days—no perforation) if the zinc content is kept <0.025 wt %.

EXAMPLE 3

A series of three alloys were cast, homogenized and extruded into 0.014 inch×0.016 inch tubing in the same manner as in Example 2. A commercially produced AA3102 ingot was also included The alloys had the compositions shown in Table 4 below:

TABLE 4

| Cast | Si | Fe | Cu | Mn | Zn | Ni | Ti |
|---|---|---|---|---|---|---|---|
| MKX | 0.08 | 0.08 | 0.0016 | 0.24 | 0.17 | 0.0022 | 0.0011 |
| MKY | 0.08 | 0.41 | 0.0017 | 0.24 | 0.17 | 0.0024 | 0.01 |
| MGM | 0.07 | 0.07 | 0.0022 | 0.24 | 0.17 | 0.0012 | 0.14 |
| Production 3102 | 0.08 | 0.39 | 0.0179 | 0.21 | 0.014 | 0.0047 | 0.01 |

A total of ten 8 inch lengths of tubing were produced for each alloy. Half of these were given a 6% stretch to simulate the cold work associated with coiling/uncoiling and straightening operations, which would occur in an industrial situation. The tubes were then exposed to a vacuum brazing cycle as in Example 2 before being SWAAT tested for 20 days.

All the tubes failed a 20 day SWAAT test by perforation as tested by compressed air.

In terms of composition the three experimental alloys all had low copper and nickel levels but had a deliberate zinc addition of 0.17 wt %. Alloy MGM also contained an increased Ti addition. The production alloy contained low zinc but contained copper >0.006 wt %. The results show that for vacuum brazed tubing, an alloy with low copper and nickel along with a deliberate zinc addition does not give 20 day SWAAT life.

What is claimed is:

1. A furnace brazed aluminum alloy extruded product having corrosion resistance wherein the alloy consists essentially of an aluminum alloy of the AA3000 series containing less than 0.006% by weight copper, less than 0.005% by weight nickel and less than 0.03% by weight zinc, and wherein the extruded product is devoid of any surface coating of zinc.

2. An aluminum alloy extruded product according to claim 1 wherein the extruded product is a beat exchanger tube.

3. An aluminum alloy extruded product according to claim 1 wherein the alloy contains up to 1.5% by weight manganese, up to 0.70% by weight iron, up to 0.02% by weight titanium, up to 0.30% by weight silicon, less than 0.006% by weight copper, less than 0.005% by weight nickel and less than 0.03% by weight zinc, the balance aluminum and incidental impurities.

4. An aluminum alloy extruded product according to claim 3 wherein the alloy contains 0.001–0.5% by weight manganese, 0.001–0.7% by weight iron, 0.001–0.02% by weight titanium, 0.001–0.3% by weight silicon, less than 0.006% by weight copper, less than 0.005% by weight nickel, 0.001–0.02% by weight zinc, the balance aluminum and incidental impurities.

5. An aluminum alloy extruded product according to claim 1 having a corrosion resistance sufficient to pass a 20 day SWAAT corrosion test.

* * * * *